United States Patent [19]

Swain

[11] 4,183,487

[45] Jan. 15, 1980

[54] WALL BRACKET

[75] Inventor: C. Daniel Swain, Tacoma, Wash.

[73] Assignee: Comerco, Inc., Tacoma, Wash.

[21] Appl. No.: 861,016

[22] Filed: Dec. 15, 1977

[51] Int. Cl.[2] ..... E04G 3/00

[52] U.S. Cl. ..... 248/214; 248/243; 248/250

[58] Field of Search ..... 248/214, 215, 241, 243, 248/244, 245, 246, 239, 240.4, 250; 108/144, 152

[56] References Cited

U.S. PATENT DOCUMENTS

| | | | |
|---|---|---|---|
| 756,648 | 4/1904 | Kade | 248/250 |
| 1,647,008 | 10/1927 | Lawrence | 248/215 |
| 1,924,074 | 8/1933 | O'Halloran | 248/214 |
| 2,460,193 | 1/1949 | Ravdenkolb | 248/214 |

FOREIGN PATENT DOCUMENTS

| | | | |
|---|---|---|---|
| 105712 | 2/1927 | Fed. Rep. of Germany | 248/241 |

*Primary Examiner*—Robert A. Hafer
*Attorney, Agent, or Firm*—Gipple & Hale

[57] ABSTRACT

A wall bracket system is disclosed which is supported on a vertical wall by a single horizontally extending wall rail. The bracket system comprises a bracket, key member and spacer member. The bracket is provided with a vertically adjustable key member which attaches to the rear surface of the bracket and supports the same by being held in a channel of the wall rail. A vertically adjustable spacer member is also provided which serves to space the lower portion of the bracket from the vertical wall. Additionally, a support member is provided which slides over and is held secure by a plurality of upwardly extending screw heads. This support member is secured to the underside of a shelf or other item to be supported by the bracket and after sliding over the protruding screw heads provides an anti-lateral displacement mechanism.

8 Claims, 6 Drawing Figures

14
18
20
10
12
32
34
36
54
22
100

118
112
110
120
114
120
116

56
34
52
40
44
54
46
36
50
60
48
42
58

92
90
28
26
96
98
24
30
94
18
16
15
56
34
16
44
36
16

WALL BRACKET

BACKGROUND OF THE INVENTION

This invention relates to a wall bracket and associated elements for supporting a series of shelves or a work surface at a plurality of different heights. More specifically, the device comprises a wall bracket which further comprises two flat perpendicular surfaces, the first of which supports a shelf with the second surface abutting a horizontal wall rail and the vertical wall surface.

The first of the flat surfaces is provided with a plurality of protruding screws or holding members, while the other flat surface is provided with a plurality of vertically spaced apertures. The flat surface which is provided with the apertures is adapted to be placed flush against a wall rail and supported by a key member. The key member is specifically adapted to be supported by the wall rail member, which member is secured to the vertical wall surface. The key member is adapted to be received into any one of the plurality of vertically spaced apertures and, therefore, the bracket member is vertically adjustable with respect to the wall. A spacer member is also provided which is adapted to be secured to the vertical flat surface of the bracket, which member facilitates the level orientation of the other flat perpendicular surface. The spacer member is also vertically adjustable and serves to space the bottom portion of the bracket from the wall.

DESCRIPTION OF THE PRIOR ART

The present invention, as mentioned, is particularly suitable for supporting a plurality of shelves or a work surface or tabletop member. Wall brackets have previously been provided, which brackets are provided with key-like members which fit through and engage a plurality of apertures or holes in vertically extending, wall-secured rails. Typically, a shelving system comprises a pair of vertically extending, yet spaced, wall rails, which rails are provided with a plurality of vertically spaced rectangular apertures. In operation, a wall bracket which is provided with a key member is inserted into the desired rectangular aperture in order to provide vertical adjustability. These conventional systems suffer from the basic disadvantage in that they require unsightly vertically extending wall rails to be used. Conversely, the invention disclosed herein utilizes only a single horizontally extending wall rail, the provision of which is aesthetically pleasing, as well as adaptable and space conserving.

Specifically, because the wall rail is on a single horizontal plane, it does not extend above or below the supported shelves, table top, etc. and is largely hidden by the structure it supports. Hence it does not interfere with utilization of the wall above and below the bracket for other purposes. Also, since the wall rail may extend around the entire room, the support brackets may be positioned at any point along the wall. This, plus its vertical adjustability (as hereinafter described), provides a considerable degree of position adjustability.

The present invention fulfills many of the same purposes as the prior art, yet it is easier to install. The present invention requires only a single horizontally extending wall rail to be secured to a vertical wall surface, as contrasted to the pair of parallel vertically extending wall rails of the prior art. Thus, it can be seen that the present invention does not require any precise installation with respect to making sure the wall rails are mounted in a parallel configuration.

In the prior art systems for supporting a plurality of shelves or other horizontally extending members, the shelves or items which are supported typically rest upon the flat planar surface of the bracket which is perpendicular to the vertical wall. Unless secured to the wall brackets, the horizontal surfaces of the prior art possess the inherent possibility of moving laterally or becoming dislodged from the wall brackets. Quite obviously, this is a result to be avoided. The prior art discloses the use of conventional fastening means for securing a shelving member to the wall bracket. Conventionally, this is performed by a screw passing through an aperture of the wall bracket directly into the shelf to be secured. This method, suffers a disadvantage in that the removal of the shelf, in order to have a different item supported, is tedious and difficult requiring the screw fasteners to be removed from the shelf. Thus, it can be seen that the prior art substantially diminishes the interchangeability of shelves or items to be supported. Of course, the prior art allows the brackets and shelves to be moved about as a complete unit, yet this requires an excessive number of brackets for complete interchangeability.

The present invention, disclosed herein, eliminates the above described problem. The flat planar surface which is perpendicular to the vertical wall is provided with a plurality of upwardly protruding screw fasteners, the heads of which extend above the surface of the bracket. A sliding support member, previously secured to the underside of the shelf or item to be supported, fits over and slides on top of the protruding members. In this manner, the wall bracket secures the shelf or item to be supported without compromising the adjustability of the system. If it is desired to change the shelf or item to be supported, then the shelf or item is merely slid off of the upwardly protruding screw heads and another item slid back thereon. The present system is completely adjustable without the need for moving the bracket and shelf as a complete unit. This is a considerable advantage over the prior art.

The prior art wall bracket support systems generally provide the wall bracket with more than one key which fits into the previously mentioned rectangular apertures. The lower of the two keys serves as a leveling device for the bracket. The lower key passes through a rectangular aperture and allows the bottom of the vertical flat surface of the wall brackets to abut against the vertically extending wall rails. In this way, the moment force of the weight of the shelf or item to be supported is counterbalanced and, therefore, the shelf is held in a level fashion. Yet, it will be appreciated that the prior art system again suffers from the basic disadvantage in that the lowermost key element is in a fixed relation with respect to the uppermost key element. Thus, the degree of counterbalancing is fixed. Conversely, the present invention, while allowing the uppermost key member to be vertically adjustable, also allows the leveling or spacing member to be vertically adjustable which substantially facilitates the leveling of the entire system and thus allows superior system interchangeability.

SUMMARY OF THE INVENTION

The present invention contemplates the use of a pair of wall brackets in order to support a shelf or other item. Each wall bracket comprises two flat perpendicular surfaces. One of the flat surfaces is provided with a plurality of apertures for receiving a key member and a leveling member. The key member is specifically adapted to be supported and held within a single horizontally extending wall rail. The wall rail is permanently secured to a vertical wall surface. Both the key member and the leveling member are vertically adjustable. The other flat surface of the wall bracket, which extends perpendicular to the wall surface, provides the support surface for the shelf or other item to be supported. This flat surface is provided with a plurality of upwardly protruding screw heads. The screw heads are specifically adapted to be secured within a channel of a flat support member which is slid over the aforementioned screw heads. The support member is permanently fastened underneath the shelf or item desired to be supported by the system. In this manner, shelves or other items which are desired to be supported can easily be removed from the wall bracket and replaced with different shelves or other articles sought to be supported.

The above mentioned purposes are more readily apparent when read in conjunction with the following detailed description of the preferred embodiment of the present invention.

DETAILED DESCRIPTION OF THE DRAWINGS

Figures 1, 2, 3:
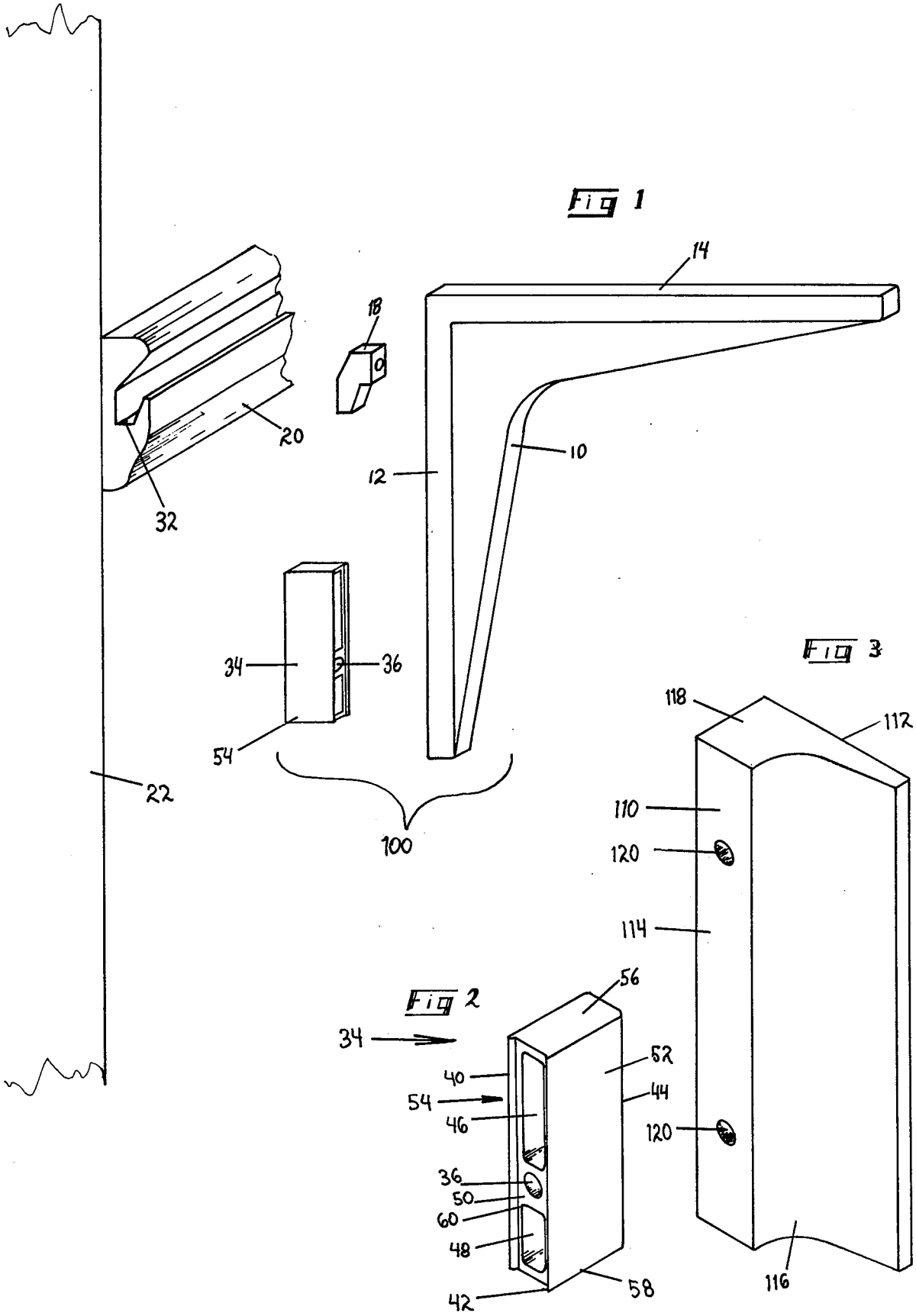
FIG. 1 is an exploded view of the wall bracket assembly and wall rail.
FIG. 2 is a perspective view of the spacer element.
FIG. 3 is an enlarged alternate embodiment of the spacer element.

As best seen in FIG. 1, the wall bracket assembly 100 comprises a bracket 10, a key element 18 and a spacer element 34. When the key element and spacer element are secured to the bracket 10, as will be further described, the wall assembly 100 is supported by the wall rail 20. The wall rail 20 is securely attached to a vertical wall 22. The wall bracket, a one-piece unit, 10 comprises a vertical planar surface 12 and a horizontal planar surface 14 perpendicular thereto. The rear flat surface 15 of vertical planar surface 12 is provided with a plurality of vertically spaced holes or apertures 16. The key element 18 is comprised of side walls 96, 98, inclined surface 90, top surface 92, and rear vertical surface 94. When the key element 18 is attached to the rear flat surface 15 of vertical planar surface 12, the vertical surface 28 of the key element will abut the rear flat surface 15. An aperture 24 is provided in the key element which passes completely through the same and is provided with a shoulder 26. The shoulder 26 serves to prevent a wood screw or other conventional fastening means from passing completely through the key element. Thus, it can be seen that when a wood screw or other conventional fastening means is placed through the aperture 24, the key element 18 can be secured to the bracket 10. It will be appreciated that the key element 18 can be placed into any one of the desired vertically spaced holes 16 located within the rear flat surface 15. The downwardly pointed finger 30 of key element 18 is specifically configured so as to fit within the channel 32 of the wall rail 20. Thus, it can be seen that securing the key element 18 within any one of the desired vertically spaced holes 16 results in a wall bracket 10 which is vertically adjustable with respect to the permanently attached horizontal wall rail 20.

Figure 4:
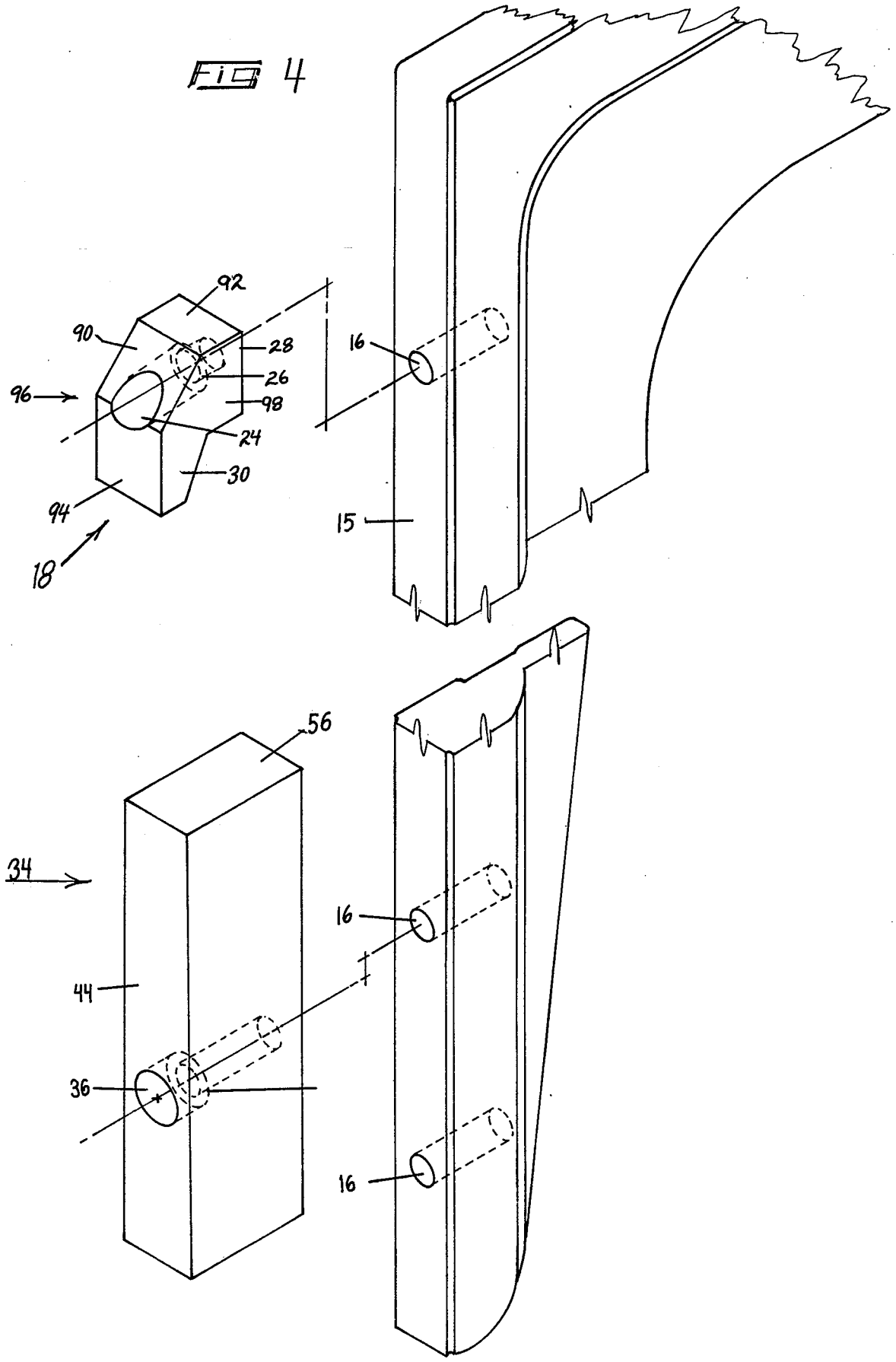
FIG. 4 is an enlarged exploded perspective view of the wall bracket assembly shown in FIG. 1.

The spacer element 34, as best seen in FIGS. 1, 2 and 4, comprises vertical sides 52 and 54, a top 56, bottom 58, bracket abutment face 60, and flat vertical surface 44. The bracket abutment face 60 comprises legs 40 and 42 which extend beyond the bracket abutment face 60. The bracket abutment face 60 is provided with an aperture 36 through which a wood screw or other conventional fastening means may pass. The flat vertical surface 44, when the spacer element is secured to the bracket, abuts against the vertical wall 22. The aperture 36 is provided with a shoulder 38 which prevents the wood screw or other conventional fastening means from passing completely through the spacer element. A horizontal member 50 of bracket abutment face 60 serves to define two cavities 46 and 48 of the spacer element.

In operation, the spacer element is secured to any one of the plurality of vertically spaced holes 16 of the bracket by means of a wood screw or other conventional fastening means which passes through aperture 36 of the spacer element. The vertically extending legs 40 and 42 of the spacer will abut against the vertical planar surface 12 of the wall bracket 10. When the key element 18 is fastened to the wall bracket 10 and then inserted into the channel 32 of the wall rail 20, then it becomes necessary in order to keep the horizontal planar surface 14 perpendicular to the vertical wall to use the spacer element 34. The spacer element 34 serves to space the lower portion of the vertical planar surface 12 of wall bracket 10 from the vertical wall to which the wall rail 20 is attached. The width of the spacer element 34 is sufficient to keep the horizonal planar surface 14 perpendicular to the vertical wall 22. As previously mentioned, the spacer element 34 is also vertically adjustable. The vertical adjustability is provided when the wood screw passes through the spacer element into any desired one of the vertically spaced holes 16. In this manner, the spacer element serves to counteract the moment force about the key element caused by any shelf or other weight which is supported by the horizontal planar surface 14. The key element 18 allows the wall bracket to be vertically adjusted for any desired height while the vertical adjustability of the spacer element allows a shelf or other object to be supported upon the horizontal planar surface 14 to be placed at any point along the horizontal planar surface without placing undue stress upon the key element.

FIG. 3 discloses an alternate embodiment of the spacer element wherein it is sought to spread the moment forces along a greater portion of the vertical wall. The alternate spacer element 110 comprises a vertical wall abutment surface 112, flat wall bracket abutment surface 114, curved surface 116 and vertical surface 118. Holes or apertures 120 are provided in the vertical bracket abutment surface 114. The holes or apertures 120 function in the same manner as hole or aperture 36 of the preferred embodiment of the spacer element. A wood screw or other conventional fastening means serves to fasten or secure the alternate spacer element 110 to the rear flat surface 15 of the bracket 10. Thus, it can be seen that when the alternate spacer element is secured to the wall bracket, the vertical flat wall abutment surface 112 will contact and serve to space the lower portion of the rear flat surface 15 of wall bracket 12 from the vertical wall 22. Due to the fact that the vertical wall abutment 12 is relatively large with respect to the surface area of the vertical wall bracket abutment surface 114, the moment forces produced by a weighted object being supported upon the horizontal planar surface 14 are thereby spread over a greater surface area of the vertical wall.

Figure 5:
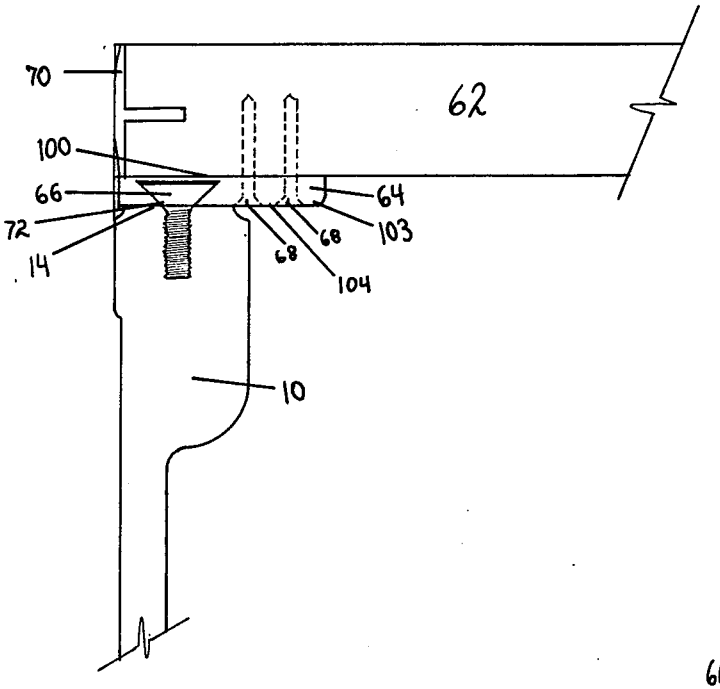
FIG. 5 is a partial cross-sectional view of the wall bracket and associated shelf.
Figure 6:
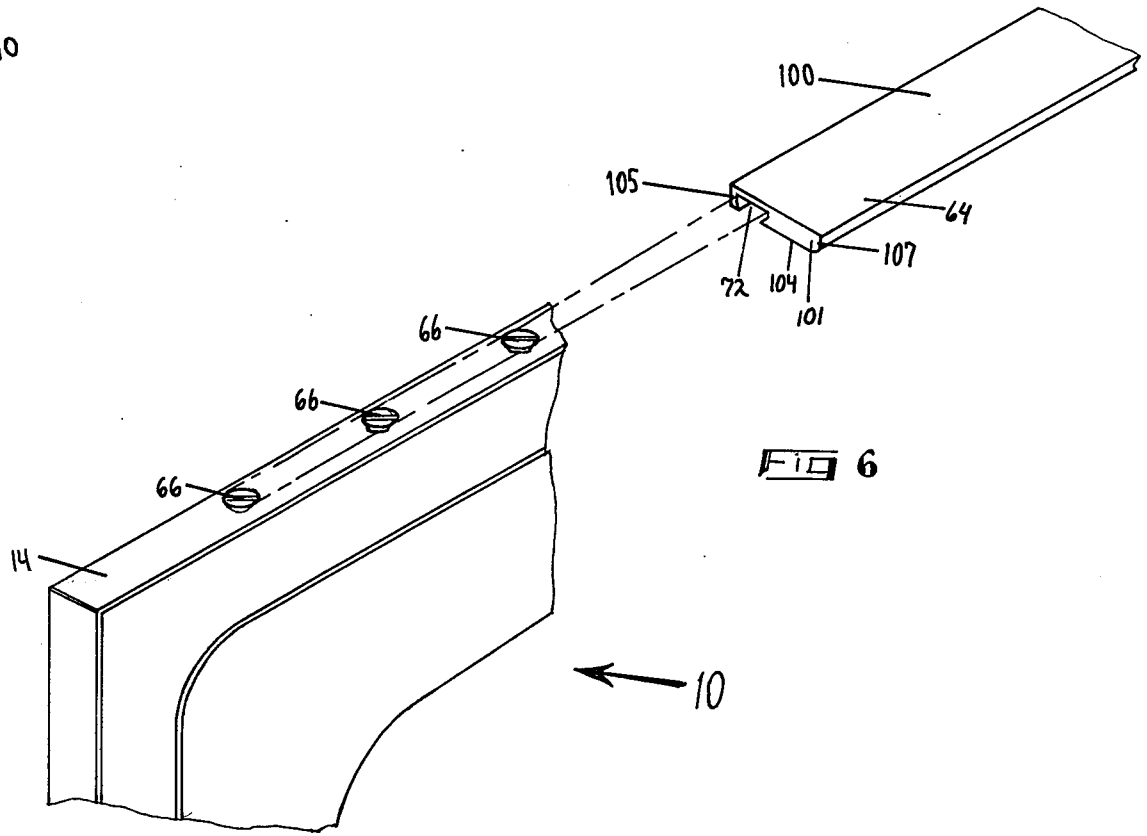
FIG. 6 is a partial perspective view of the wall bracket with support member removed.

FIGS. 5 and 6 disclose the method in which a horizontal planar surface may be secured to the wall bracket. As previously mentioned, it is desireable to secure a horizontal planar surface or other work surface to the wall bracket in order to provide greater stability to the system. However, the prior art suffers from the basic disadvantage that the wall brackets are either not fastened to the horizontal planar surface and, therefore, the horizontal surface tends to become dislodged or, alternatively, the wall brackets are permanently secured to the horizontal support surface and, therefore, the movement of the horizontal support surface requires the bracket attached thereto to be also moved. The present invention, however, provides a method and apparatus for securing a horizontal planar surface to the wall bracket which provides superior stability to the system and yet allows the shelves or horizontal support surfaces to be replaced without the necessity of moving the wall brackets which are supported and secured to a vertical wall.

The horizontal planar surface 14 of bracket 10 is provided with a plurality of spaced upwardly protruding elements, preferably the heads of wood screws 66. The wood screws are secured to the horizontal planar surface 14 of bracket 10, yet are not flush with the horizontal planar surface 14. That is to say, the heads of the wood screws or other protruding members 66 extend above the horizontal planar surface 14. A support member 64 comprises a top planar surface 100, a bottom surface 104, and two side surfaces 105 and 107. The back and front of the support member 101 and 103, respectively, are provided with an aperture for sliding the support member 64 over the protruding members or wood screws 66. The bottom surface 104 of support member 64 is provided with a longitudinal channel 72 which is specifically configured to receive and hold securely the protruding members or wood screws 66. The shelf or work surface 62 is shown with a side protective molding 70 attached thereto. The support member 64 is permanently secured to the underside of the shelf or work surface 62 by means of wood screws or other conventional fastening means 68.

In operation, when it is desired to secure a shelf or work surface 62 to a wall bracket 10, the support member 64 is secured to the underside of the shelf or work surface 62 by means of wood screws 68. The horizontal planar surface 14 of the wall bracket 10 is provided with upwardly protruding wood screw heads which receive the channel 72 of the support member 64. Thus, it can be seen that the shelf or work surface 62 may be slid over the upwardly protruding wood screw heads and thereby prevented from relative lateral displacement. When it is desired to secure a different shelf or work surface to the wall bracket 10, it is no longer necessary to remove the work surface or shelf and bracket as a complete unit, but only to remove the shelf or work surface 62 with its attached support member 64. A new work surface or shelf 62 with another support member 64 secured thereto can then be slid over the upwardly protruding members or wood screw heads. The utilization of the support member beneath the shelves or work surfaces provides superior flexibility to the system.

While the preferred embodiment of the invention has been disclosed, it is understood that the invention is not limited to such an embodiment since it may be otherwise embodied in the scope of the appended claims.

What is claimed is:

1. A vertically adjustable wall bracket system comprising a wall bracket, key member, and spacer member, said wall bracket defining a horizontal surface and a vertical surface perpendicular to said horizontal surface, a plurality of upwardly projecting protruding members removably mounted to said horizontal surface, said vertical surface being provided with a plurality of vertically spaced apertures, said wall bracket further comprising a support member which is fixedly secured to a member sought to be supported by said system, said support member defining a longitudinal channel specifically adapted to receive said upwardly protruding removable members and being adapted to be slid over the upwardly protruding members to provide longitudinal stability, said longitudinal channel and said removable members forming a tongue and groove type assembly, said key member comprising a leg member adapted to be supported by a wall rail, said key member being removably secured to any of said vertically spaced apertures, said spacer member also being secured to said vertical surface in a position beneath said key member, said spacer member serving to keep said horizontal surface of said wall bracket in a level condition.

2. A wall bracket system as claimed in claim 1 wherein said spacer member has a bracket abutment surface and a wall abutment surface, said wall abutment surface having a greater area than said bracket abutment surface.

3. A wall bracket system as claimed in claim 1 wherein said removable upwardly protruding members and said support member channel form a dovetail assembly.

4. A wall bracket system comprising a wall bracket, a key member adapted to support said wall bracket on a wall rail secured to a vertical wall, and a spacer member, said wall bracket comprising a first leg and a second leg oriented perpendicular to said first leg, said first leg being provided with at least two apertures for receiving fastening means for securing and vertically adjusting said key member and spacer member to said first leg, said key member being located above said spacer member and adapted to be mounted in a channel formed in said wall rail, said spacer member being positioned between said first leg and said vertical wall to space the lower portion of said first leg from said vertical wall and being provided with a planar surface for abutting said vertical wall and a pair of vertically extending legs for contacting said first leg of said wall bracket, said wall bracket second leg providing a support surface and having mounted thereon a plurality of removable upwardly protruding members, said system further comprising a support member, said support member being capable of being secured to the underside of an item sought to be supported, said support member being formed with a longitudinal channel which is configured to receive and hold said plurality of upwardly protruding members within said channel so that said support member can move in only one direction.

5. A wall bracket system as claimed in claim 4 wherein said key member is provided with a downwardly pointed leg for mounting into a channel formed in a horizontal wall rail said leg comprising a planar front face, three sides perpendicular to said planar front face and one side angled away from said front face which are formed integral with a key body having five perpendicular planar sides and one angled side opposite the angled side of the leg.

6. A wall bracket system as claimed in claim 5 wherein the planar surface is greater than the contact area of said vertically extending legs with said wall bracket.

7. A wall bracket system as claimed in claim 4 wherein said upwardly protruding members are the heads of wood screws.

8. A vertically adjustable wall bracket system comprising a wall bracket, key member, and a spacer member, said wall bracket comprising a one piece horizontal surface and perpendicular vertical surface, said vertical surface being provided with a plurality of vertically spaced apertures, said key member comprising a body with a downwardly projecting leg member adapted to be mounted in and supported by a wall rail, said key member being removably secured and independently vertically adjustable to any of said vertically spaced apertures, said spacer member also being provided with a vertical surface which abuts against a wall to which the wall rail is secured, said spacer member being individually vertically adjustable and adapted to being secured to any of said vertically spaced apertures behind said vertical surface and substantially hidden from view by said vertical surface in a position beneath said key member to keep said horizontal surface of said wall bracket in a level condition, a plurality of spaced upwardly protuding members removably mounted on said horizontal surface, said upwardly protuding members comprising the heads of fasteners, said wall bracket system further comprising a support member formed with a dovetail shaped longitudinal channel fixedly secured to a member sought to be supported by said system, said support member being adapted to be slid over the upwardly protruding fastener heads so that the heads of the fasteners dovetail in the support member channel to provide stability to the system.

* * * * *